US006428183B1

(12) United States Patent
McAlpin

(10) Patent No.: US 6,428,183 B1
(45) Date of Patent: Aug. 6, 2002

(54) FLUORESCENT LIGHT FIXTURE

(75) Inventor: Kenneth M. McAlpin, League City, TX (US)

(73) Assignee: X-Tra Light Manufacturing, Inc., Houston, TX (US)

( * ) Notice: Subject to any disclaimer, the term of this patent is extended or adjusted under 35 U.S.C. 154(b) by 0 days.

(21) Appl. No.: 09/698,229

(22) Filed: Oct. 30, 2000

(51) Int. Cl.[7] ..... F21S 4/00

(52) U.S. Cl. ..... 362/225; 362/217; 362/241; 362/247; 362/404; 362/147

(58) Field of Search ..... 362/217, 225, 362/241, 247, 260, 221, 404, 408, 147

(56) References Cited

U.S. PATENT DOCUMENTS 2,721,720 A * 10/1955 Kruger
4,719,546 A * 1/1988 Spitz ..... 362/260
4,876,633 A * 10/1989 Engel ..... 362/223
4,933,820 A * 6/1990 Engel ..... 362/217
5,823,663 A * 10/1998 Bell et al. ..... 362/362

* cited by examiner

*Primary Examiner*—Thomas M. Sember
*Assistant Examiner*—Jacob Y. Choi
(74) *Attorney, Agent, or Firm*—Bill B. Berryhill

(57) ABSTRACT

An improved fluorescent light fixture of the type having an elongated housing in a downwardly opening elongated cavity of which are carried one or more tubular fluorescent lamps for emitting light below the fixture. The improvement comprises one or more upwardly opening elongated cavities defined by upper portions of the housing in which are carried one or more tubular fluorescent lamps for emitting light above the fixture.

12 Claims, 2 Drawing Sheets

FLUORESCENT LIGHT FIXTURE

BACKGROUND OF THE INVENTION

1. Field of the Invention

The present invention pertains to lighting. More specifically, the present invention pertains to, fluorescent lighting. In particular, the present invention pertains to an improved fluorescent light fixture especially suitable for office buildings, manufacturing facilities, warehouses, retail stores and any other enclosure requiring efficient lighting.

2. Description of the Prior Art

There are many types of light fixtures. They may utilize incandescent lamps, fluorescent lamps, metal halide lamps and others. One of the most accepted light fixtures, particularly for stores, warehouses, manufacturing facilities and large buildings is the fluorescent light fixture. The fluorescent light is efficient to operate and provides excellent optical efficiency.

A typical fluorescent light fixture has an elongated housing, usually made of metal or plastic with a downwardly opening elongated cavity in which is carried one or more tubular fluorescent lamps for emitting light below the fixture. The upper portion of the cavity may be painted or covered with a reflective surface and/or provided with reflectors so as to reflect some of the upwardly emitted light from the fluorescent lamps in a downward direction. In addition, a lens may be attached to the housing below the fluorescent lamps and may be designed so as to distribute the light from the fluorescent lamps in a more even manner, hide bare lamps from view or provide protection from breakage and contaminates.

In most cases, fluorescent light fixtures are designed for best efficiency at a particular elevation above the area where the light is to be provided. To place the light fixture at the proper elevation, it might be mounted or hung below the ceiling of the building in which it is installed. Since the fluorescent lamps are disposed in the downwardly opening cavity, very little light is emitted above the fixture.

As previously stated, reflectors and lenses are provided on many fluorescent light fixtures to improve the optical efficiency and even distribution of light. While improvements have been made more are continuously sought by manufacturers of such light fixtures and by the users thereof.

SUMMARY OF THE PRESENT INVENTION

The present invention is for an improved fluorescent light fixture and like most fluorescent light fixtures has an elongated housing in a downwardly opening elongated cavity of which are carried tubular fluorescent lamps for emitting light below the fixture. In addition, the housing of the fluorescent light fixture of the present invention is provided with one or more upwardly opening elongated cavities in which are carried one or more tubular fluorescent lamps for emitting light above the fixture. Thus, not only is light efficiently emitted below the fixture, light is also efficiently emitted above the fixture to provide light where none exists in fluorescent lighting fixtures of the prior art.

The surfaces of both the downwardly and upwardly opening cavities of the fluorescent light fixture of the present invention are covered with highly light reflective paint and elongated reflectors are carried, at least in the downwardly opening cavity above each of the tubular fluorescent lamps carried therein, to improve optical efficiency of the fixture. The reflectors are uniquely formed and mounted so as to allow access to portions of the housing in which ballasts may be carried for removal and replacement thereof. Other improvements in supporting the light fixture and providing electrical access thereto are disclosed.

The unique combination of elements in the fluorescent light fixture of the present invention provides both downwardly emitted light and upwardly emitted light in a superior optical efficient manner. Furthermore, the light fixture is easy to install and operate and is energy efficient. Many other objects and advantages of the invention will be apparent from reading the description which follows in the conjunction with the accompanying drawings.

DESCRIPTION OF PREFERRED EMBODIMENTS OF THE INVENTION

Figure 3:
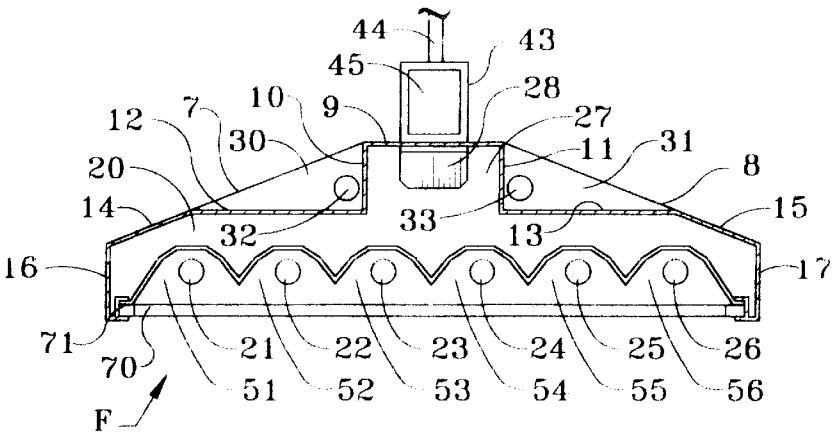
FIG. 3 is a cross-sectional view of a light fixture, such as the one illustrated in FIG. 2, according to a preferred embodiment thereof.
Figure 2:
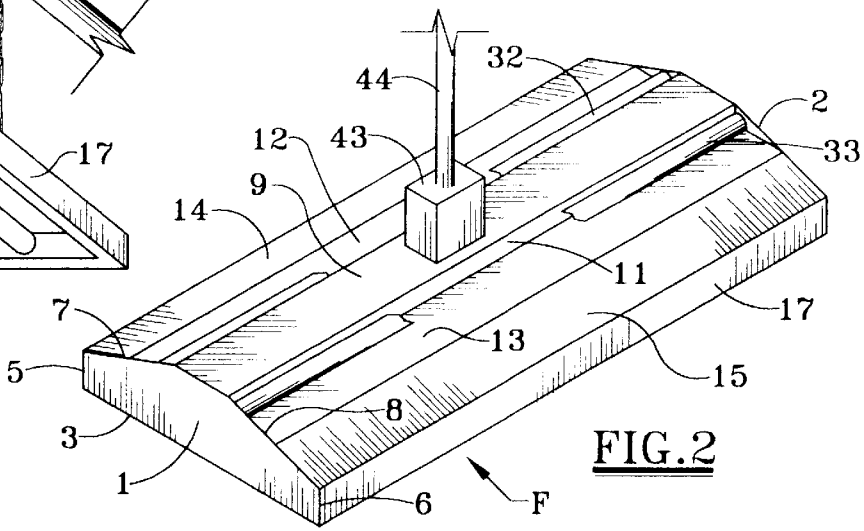
FIG. 2 is an isometric view of a fluorescent light fixture, according to a preferred embodiment thereof, as viewed from above.
Figure 1:
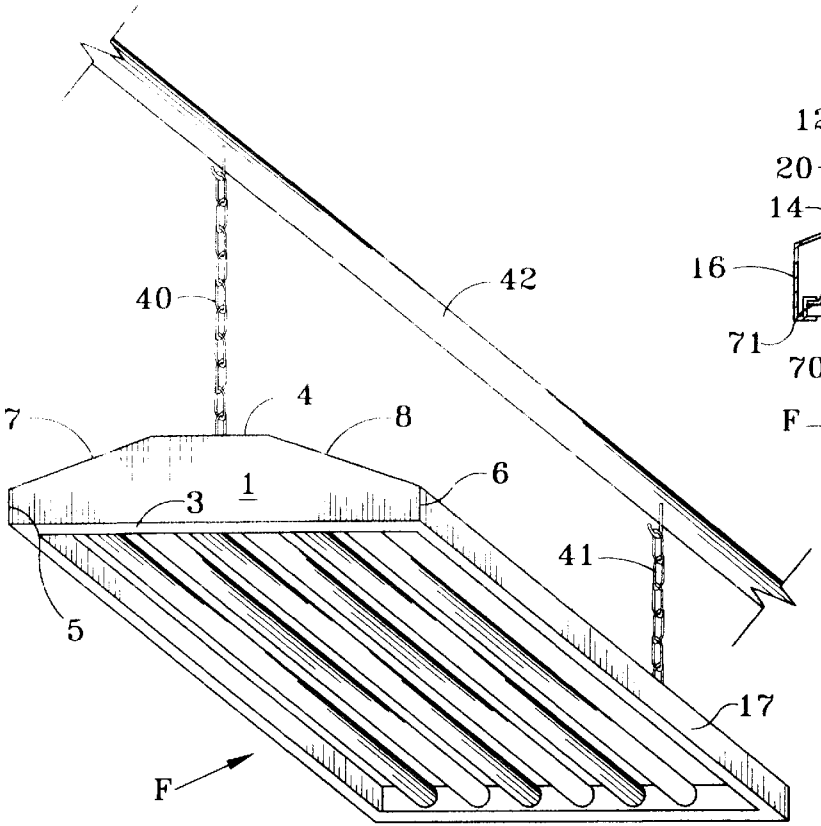
FIG. 1 is an isometric view of a fluorescent light fixture according to a preferred embodiment of the inventions as viewed from below.

Referring first to FIGS. 1, 2 and 3, there is shown an improved fluorescent light fixture F having an elongated housing. Opposite ends, 1 and 2, of the housing are formed of flat sheets of material which, as best seen with reference to end 1 in FIGS. 1 and 2, are defined by a horizontal base 3 and a shorter horizontal top 4 connected, at opposite ends, by a pair of short vertical sides 5 and 6 and a pair of longer inclined sides 7 and 8. The upper portion of the housing is formed by a central elongated horizontal section 9 joining the shorter tops of the housing ends 1 and 2 and a pair of short vertical elongated sections 10 and 11 extending downwardly from opposite sides of the central section 9. A pair of horizontal elongated sections 12, 13 project outwardly from the lower edges of the vertical sections 10 and 11 and a pair of inclined elongated sections 14, 15 are joined at upper edges thereof to edges of a respective one of the pair of horizontal elongated sections 12 and 13 and at lower edges thereof to vertical sections 16, 17. All of the sections 9–17 may be formed from a single sheet of material bent to these positions.

The lower surfaces of horizontal portions 12, 13, inclined portions 14, 15, and vertical portions 16, 17, form a downwardly opening elongated cavity 20 in which is carried, in the exemplary embodiment, six tubular fluorescent lamps 21–26, for emitting light below the fixture. It will be noted that the upper portion of the housing defined by sections 9, 10 and 11 define a smaller elongated cavity 27, above the downwardly opening cavity 20, in which one or more ballasts 28 may be disposed.

Respective pairs of the vertical sections 10 and 11, horizontal sections 12 and 13 and the inner surfaces of housing ends 1 and 2 form a pair of upwardly opening cavities 30 and 31 in each of which is disposed a tubular fluorescent lamp 32, 33 for emitting light above the fixture F.

The fixture F may be provided with means at each thereof for suspending the fixture F from two or more chains 40, 41 to a supporting structure such as a beam 42 thereabove. (See FIG. 1) In another embodiment, such as that illustrated in FIG's 2 and 3, the fixture F may be provided with a pendant mount 43 by which the fixture may be suspended from a single rod or tubular member 44. In fact, the tubular member 44 may provide conduit for electrical wiring to which power may be transmitted to the fixture F. The pendant mount 43 may actually provide a junction box with an opening 45 by which the electrical wiring in the light fixture F may be connected to wiring in the conduit from an external power source without disturbing any other portion of the light fixture F.

Figure 4:
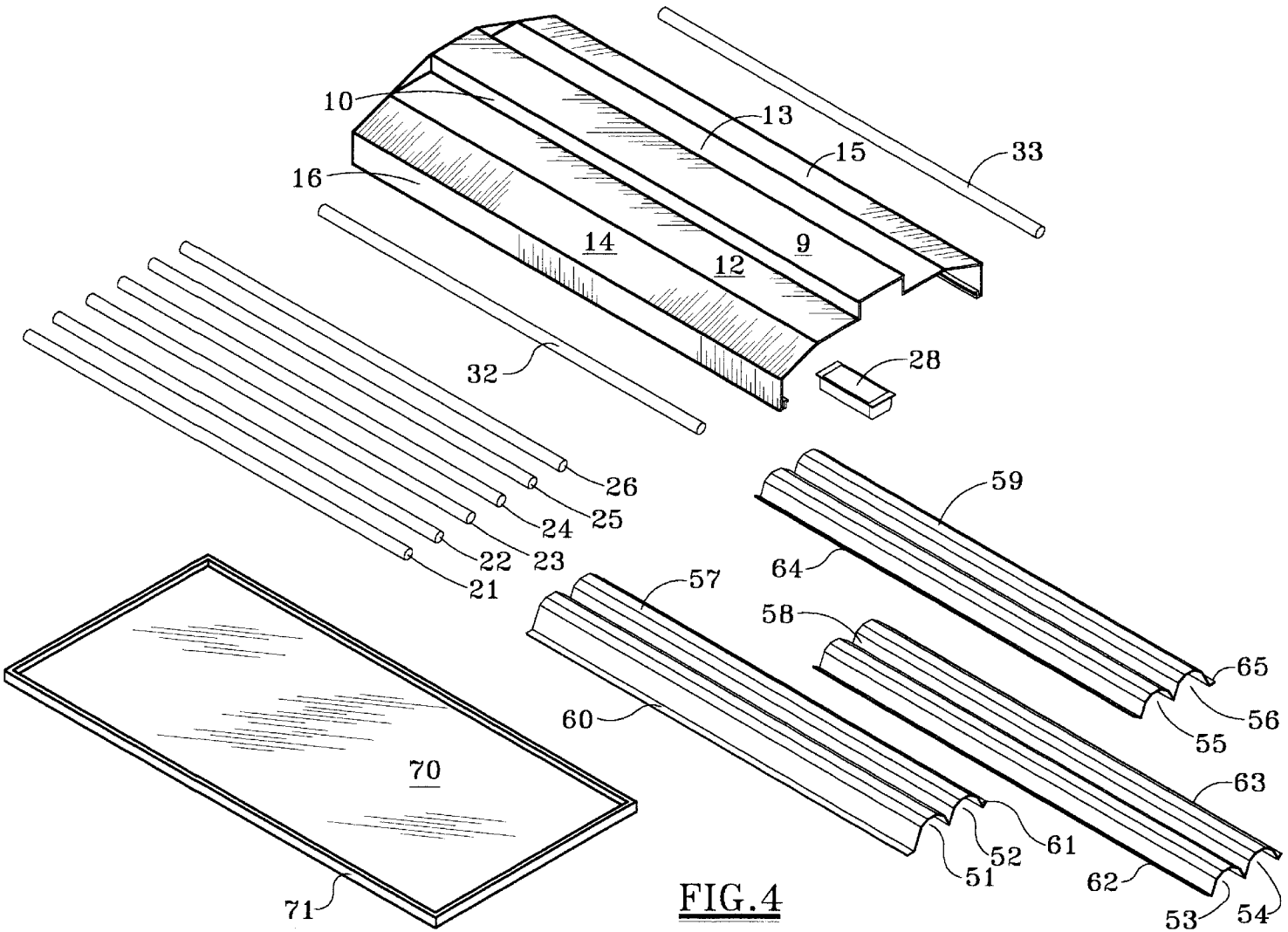
FIG. 4 is an exploded view of a light fixture, according to a preferred embodiment thereof, showing the components thereof.

The housing ends 1 and 2 and the other sections of the housing are preferably painted with a reflective white polyester paint so they are substantially reflective of light from the lamps therein. In addition, reflectors may be provided to form downwardly opening elongated channels 51–56, one for each of said fluorescent lamps 21–26, to improve optical efficiency of the fixture F. Each of the channels 51–56 are formed of a plurality of long, narrow planar surfaces, five each in the exemplary embodiment, joined along mutual edges at obtuse angles to form the channels 51–56 surrounding, at pre-selected distances therefrom, the upper half of a respective one of the fluorescent lamps 21–26 to reflect upwardly emitted light therefrom in a downward direction. The reflectors are preferably precision formed aluminum and may be polished, painted white, or provided with a mirror-like aluminum. As best seen in FIG. 4, the reflectors may be formed in units 57, 58 and 59. Each unit may be provided with mutually engaging edges 60, 61, 62, 63, 64, 65 which are locked with each other on a quarter turn. At least the center unit 58 is easily removable to allow installation and replacement of'the ballast 28 disposed in the housing above the fluorescent lamps 23 and 24. (See FIG. 3).

A flat lens 70 (see FIGS. 3 and 4) surrounded by rectangular frame 71 may be attached to the housing at the lowermost level of the downwardly opening cavity 20 through which light from the tubular fluorescent lamps 21–26 carried therein may be distributed. Lens 70 could be a clear lens, a diamond pattern lens, polycarbon plastic or even a wire cage. The primary purpose is to evenly distribute light from the lamps 21–26 and/or to protect the lamps mounted in the fixture.

FIG. 4 is an exploded view of all the components of the light fixture of the present invention. The reference numerals of FIG. 4 relate to the same reference numbers in FIGS. 1–3. This view is simply for a better understanding of the components of the fixture. It will be noted that one of the housing ends 1 has been removed to better illustrate the interior of the housing at this end.

Thus, the fluorescent light fixture of the present invention is unique in providing not only a downwardly opening cavity in which fluorescent lamps are carried but one or more upwardly opening cavities in which fluorescent lamps are carried for emitting light above the fixture. No other fluorescent light fixture of the prior art provides this feature. In addition, the fluorescent light fixture of the present invention provides unique mounting, unique light reflecting elements and other features which provide an extremely optical efficient Luminaire in an attractive and easy to install and operate manner. The fixture of the present invention is very energy efficient, providing as much light with six lamps at 224 watts as a metal halide light at 460 watts after depreciation.

At least two embodiments and several variations thereof have been described herein. However, many variations of the invention will be apparent to those skilled in the art without departing from the spirit of the invention. Accordingly, it is intended that the scope of the invention be limited only by the claims which follow.

What is claimed is:

1. An improved fluorescent light fixture of the type having an elongated housing in a downwardly opening elongated cavity of which are carried one or more tubular fluorescent lamps for emitting light below said fixture, the upper portion of said housing comprising a central elongated horizontal section, a pair of short vertical elongated sections extending downwardly from opposite sides of said central section and a pair of horizontal elongated sections projecting outwardly from lower edges of said short vertical sections, the inner surfaces of said central elongated section and said pair of short vertical elongated sections defining a smaller elongated cavity above said downwardly opening cavity, the outer surfaces of said pair of short vertical sections and said pair of horizontal sections defining a pair of elongated cavities in each one of which is carried one or more tubular fluorescent lamps for emitting light from above said housing.

2. An improved fluorescent light fixture as set forth in claim 1 in which opposite ends of said housing are formed of a sheet of material defined by a horizontal base and a shorter horizontal top connected, at opposite ends, by a pair of short vertical sides and a pair of longer inclined sides, inner surfaces of said housing ends defining ends of said pair of elongated cavities in each of which is carried at least one of said tubular fluorescent lamps for emitting light from above said housing.

3. An improved fluorescent light fixture as set forth in claim 1 in which one or more ballasts are disposed in said smaller elongated cavity, above said downwardly opening cavity in which said one or more tubular fluorescent lamps are carried.

4. An improved fluorescent light fixture as set forth in claim 3 in which there are a plurality of reflectors carried by said housing above said tubular fluorescent lamps in said downwardly opening cavity, at least one of said reflectors being removable to allow replacement of said one or more ballasts disposed in said smaller elongated cavity.

5. An improved fluorescent light fixture as set forth in claim 1 in which said housing is provided with means, at each end thereof, for suspending said fixture from two or more chains connected to supporting structure thereabove.

6. An improved fluorescent light fixture as set forth in claim 1 in which said housing is provided, near the center thereof, with a pendant mount by which said fixture may be suspended on a single rod or tubular member.

7. An improved fluorescent light fixture as set forth in claim 6 in which an enclosed junction box is provided at said pendant mount having an opening thereinto by which the electrical wiring in said light fixture may be connected to an external power source.

8. An improved fluorescent light fixture as set forth in claim 1 in which the surfaces of both said downwardly opening and said pair of cavities are covered with light reflective paint.

9. An improved fluorescent light fixture as set forth in claim 1 comprising elongated reflectors carried by said housing in said downwardly opening cavity above each of said one or more tubular fluorescent lamps carried therein to improve the optical efficiency of said fixture.

10. An improved fluorescent light fixture as set forth in claim 9 in which said reflectors are formed of narrow downwardly opening channels, one for each of said fluorescent lamps, the inner surfaces of which are formed by a plurality of long narrow planar surfaces joined along mutual edges at obtuse angles to form a channel surrounding, at a preselected distance therefrom, the upper half of a respective one of said fluorescent lamps to reflect upwardly emitted light in a downward direction.

11. An improved fluorescent light fixture as set forth in claim 9 in which there are a plurality of said elongated reflectors carried by said housing, at least one of said reflectors being removable to allow installation and replacement of one or more ballasts disposed in said housing above said one or more fluorescent lamps carried in said downwardly opening elongated cavity.

12. An improved fluorescent light fixture as set forth in claim 9 in which a lens is carried by said housing at the lowermost level of said downwardly opening cavity and through which light from said tubular fluorescent lamps carried therein is distributed.

* * * * *